US005311414A

United States Patent [19]

Branham, Sr.

[11] Patent Number: 5,311,414

[45] Date of Patent: May 10, 1994

[54] CHRISTMAS LIGHT MOUNTING APPARATUS

[76] Inventor: Henry J. Branham, Sr., 117 Buccaneer Dr., San Diego, Calif. 92114

[21] Appl. No.: 9,052

[22] Filed: Jan. 26, 1993

[51] Int. Cl.[5] ..... F21V 21/00

[52] U.S. Cl. ..... 362/249; 362/152; 362/359; 362/374; 362/457

[58] Field of Search ..... 362/151, 152, 249, 267, 362/351, 359, 360, 361, 374, 457

[56] References Cited

U.S. PATENT DOCUMENTS

| | | | |
|---|---|---|---|
| 1,485,472 | 3/1924 | Van Bloem | 362/374 |
| 1,524,963 | 2/1925 | Baker | 362/359 |
| 1,677,678 | 7/1928 | Maurer | 362/359 |
| 3,692,993 | 9/1972 | Robinson | 362/249 |
| 3,836,766 | 9/1974 | Auerbach | 362/374 |
| 4,330,814 | 5/1982 | Baldwin et al. | 362/374 |
| 4,626,965 | 12/1986 | Gupta et al. | 362/249 |
| 5,067,061 | 11/1991 | Prickett | 362/249 |

FOREIGN PATENT DOCUMENTS

| | | | |
|---|---|---|---|
| 69104 | 4/1945 | Norway | 362/359 |

*Primary Examiner*—Ira S. Lazarus
*Assistant Examiner*—Alan B. Cariaso
*Attorney, Agent, or Firm*—Leon Gilden

[57] ABSTRACT

An elongate housing structure having a base plate, a first planar cover plate, and a second V-shaped cover plate hingedly mounted to the first planar cover plate is provided to selectively provide viewing of Christmas tree sockets and bulbs contained within the housing structure for permanent mounting relative to an exterior surface of a dwelling.

2 Claims, 4 Drawing Sheets

CHRISTMAS LIGHT MOUNTING APPARATUS

BACKGROUND OF THE INVENTION

1. Field of the Invention

The field of invention relates to Christmas light apparatus, and more particularly pertains to a new and improved Christmas light mounting apparatus wherein the same is arranged for permanent mounting to an exterior surface of a building or dwelling.

2. Description of the Prior Art

Various Christmas light mounting structure is available in the prior art and exemplified by U.S. Pat. Nos. 4,821,158; 5,024,406; 4,714,219; 4,769,749; and 3,883,926.

The instant invention attempts to overcome deficiencies of the prior art by the employment of a housing structure arranged to afford protection to Christmas tree lights during periods of non-use, wherein the housing is arranged for opening to permit viewing of the light members during the Christmas season.

SUMMARY OF THE INVENTION

In view of the foregoing disadvantages inherent in the known types of Christmas light mounting structure now present in the prior art, the present invention provides a Christmas light mounting apparatus wherein the same is directed for the selective viewing of Christmas lights contained within a housing. As such, the general purpose of the present invention, which will be described subsequently in greater detail, is to provide a new and improved Christmas light mounting apparatus which has all the advantages of the prior art Christmas light mounting structure and none of the disadvantages.

To attain this, the present invention provides an elongate housing structure having a base plate, a first planar cover plate, and a second V-shaped cover plate hingedly mounted to the first planar cover plate, provided to selectively provide viewing of Christmas tree sockets and bulbs contained within the housing structure for permanent mounting relative to an exterior surface of a dwelling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be bette. appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas light mounting apparatus which has all the advantages of the prior art Christmas light mounting structure and none of the disadvantages.

It is another object of the present invention to provide a new and improved Christmas light mounting apparatus which may be easily and efficiently manufactured and marketed.

It is a further object of the present invention to provide a new and improved Christmas light mounting apparatus which is of a durable and reliable construction.

An even further object of the present invention is to provide a new and improved Christmas light mounting apparatus which is susceptible of a low cost of manufacture with regard to both materials and labor, and which accordingly is then susceptible of low prices of sale to the consuming public, thereby making such Christmas light mounting apparatus economically available to the buying public.

Still yet another object of the present invention is to provide a new and improved Christmas light mounting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
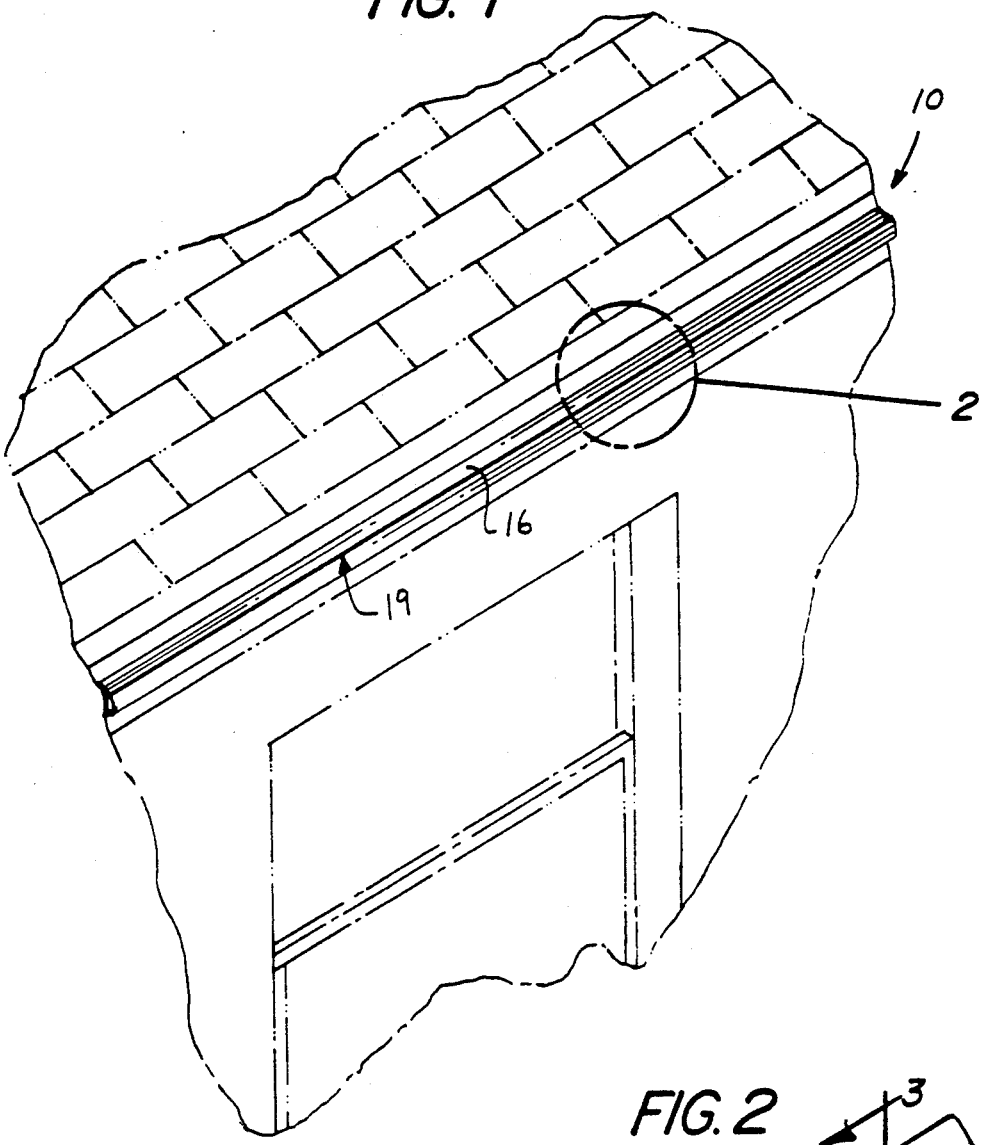
FIG. 1 is an isometric illustration of the invention mounted to an exterior surface of a dwelling.
Figure 2:
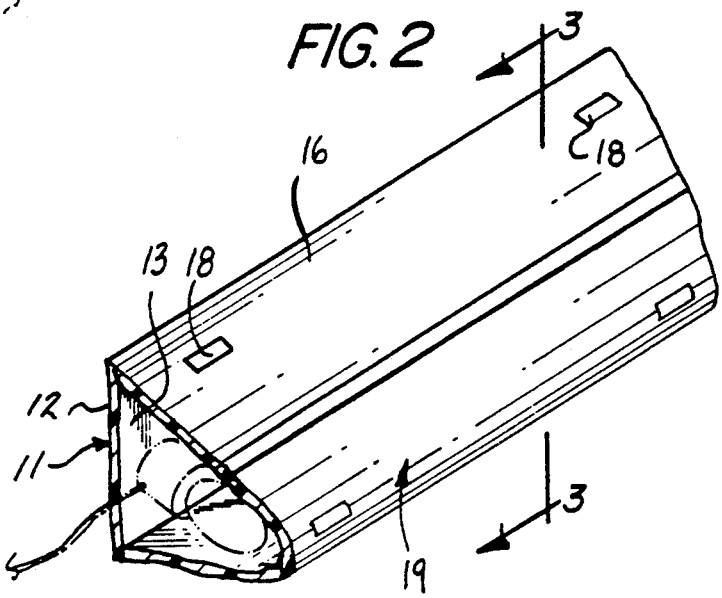
FIG. 2 is an enlarged isometric illustration of section 2 as set forth in FIG. 1.
Figure 3:
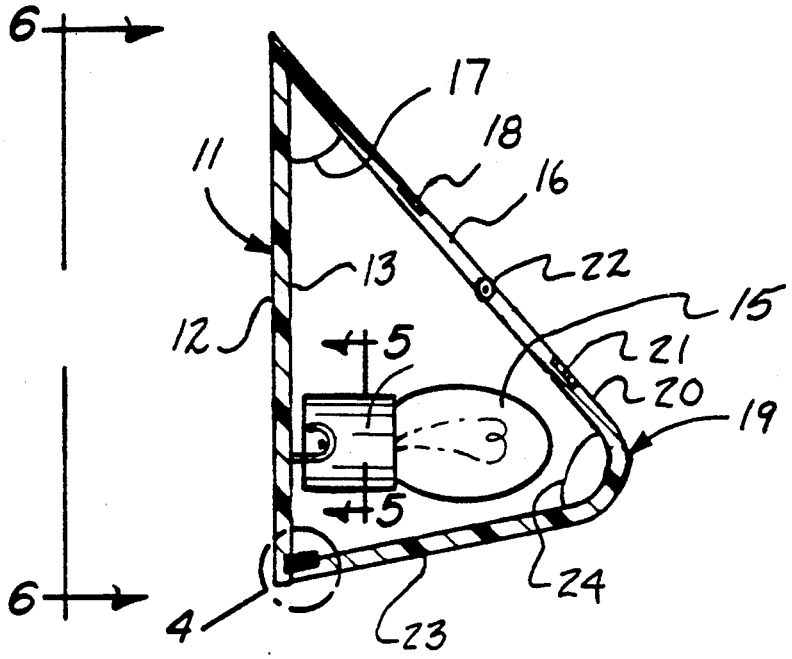
FIG. 3 is an orthographic view, taken along the lines 3—3 of FIG. 2 in the direction indicated by the arrows.
Figure 4:
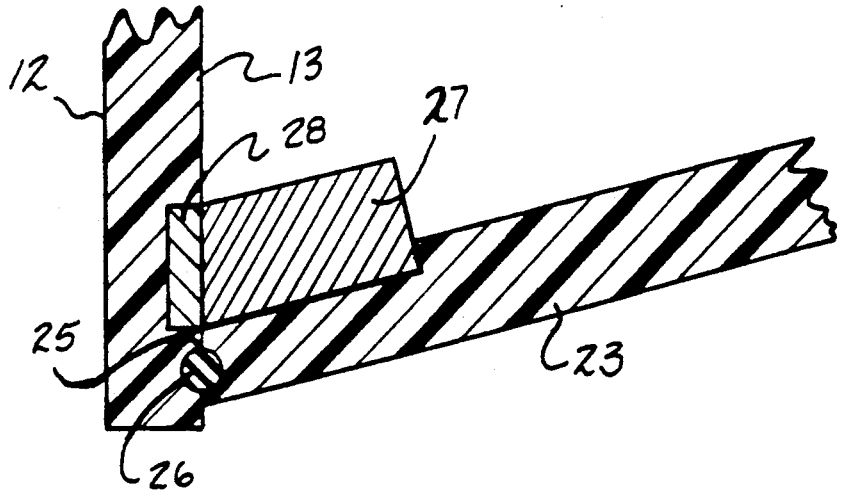
FIG. 4 is an enlarged orthographic view of section 4 as set forth in FIG. 3.
Figure 5:
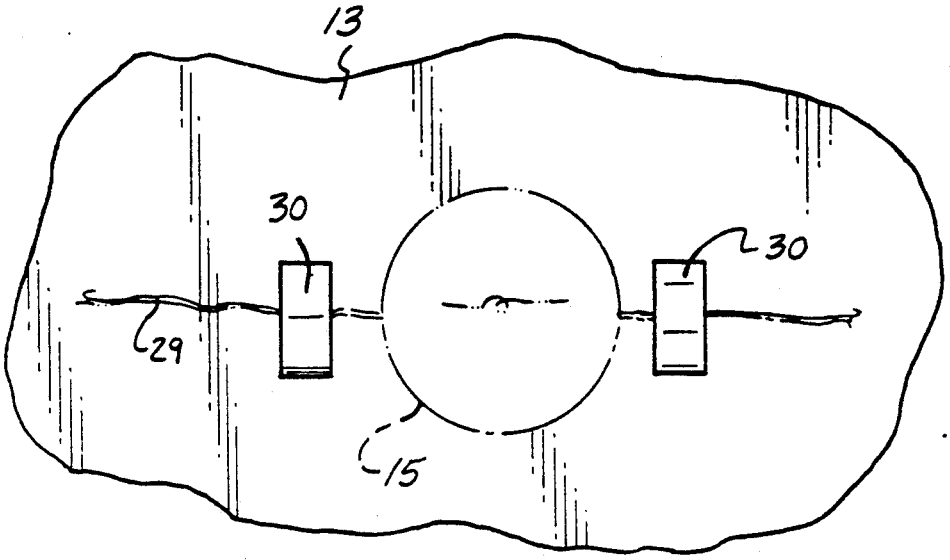
FIG. 5 is an orthographic view, taken along the lines 5—5 of FIG. 3 in the direction indicated by the arrows.

With reference now to the drawings, and in particular to FIGS. 1 to 8 thereof, a new and improved Christmas light mounting apparatus embodying the principles and concepts of the present invention and generally designated by the reference numeral 10 will be described.

More specifically, the Christmas light mounting apparatus 10 of the instant invention essentially comprises a base plate 11 arranged for mounting to an eave or other suitable exterior surfaces of an associated dwelling, as indicated in FIG. 1. The base plate is formed with a rear wall 12 and a front wall 13 (see FIGS. 2 and 3 for example), with a row of spaced bulb sockets 14 mounted to the front wall 13, with each of the bulb sockets having a bulb member 15 therewithin for selective illumination in a manner known in the prior art. A first planar cover plate 16 is mounted from an uppermost edge of the base plate 11 defining an acute first angle 17 between the front wall 13 and the first cover plate 16. Spaced ferrous metallic plates 18 are mounted to an exterior surface of the first planar cover plate 16. A second V-shaped cover plate 19 is pivotally mounted to the first cover plate 16 about a hinge 22. The second cover plate 19 includes a second plate first web 20 mounted to the hinge 22, having a row of first magnets 21 mounted to an exterior surface of the second plate first web 20 for selective engagement with the first ferrous metallic plates 18 to secure the second V-shaped cover plate 19 in a raised orientation relative to the first cover plate 16 to provide for visual viewing of the bulb members 15 during use during the Christmas season and the like. The second cover plate first web 20 mounted to the second cover plate second web 23 defines a second acute angle 24 therebetween. The second web is formed with a second web end 25 arranged for selective communication with the front wall 13, with a first end of the second web 23 mounted to the first web 20. The second web second end 25 includes a sealing strip 26 and a second magnet 27. A plurality of such second magnets may be provided if desired, with at least one of second magnets 27 provided for securement to a second ferrous metallic plate 28 mounted to the front wall 13 to secure the second V-shaped cover plate 19 into engagement selectively with the base plate 11, in a manner as indicated in FIGS. 1–4. An electrical conductive cable 29 is illustrated in the FIG. 5 to provide for electrical communication between the various bulbs 15 and secured to the front wall 13 by securement flanges 30.

Figure 6:
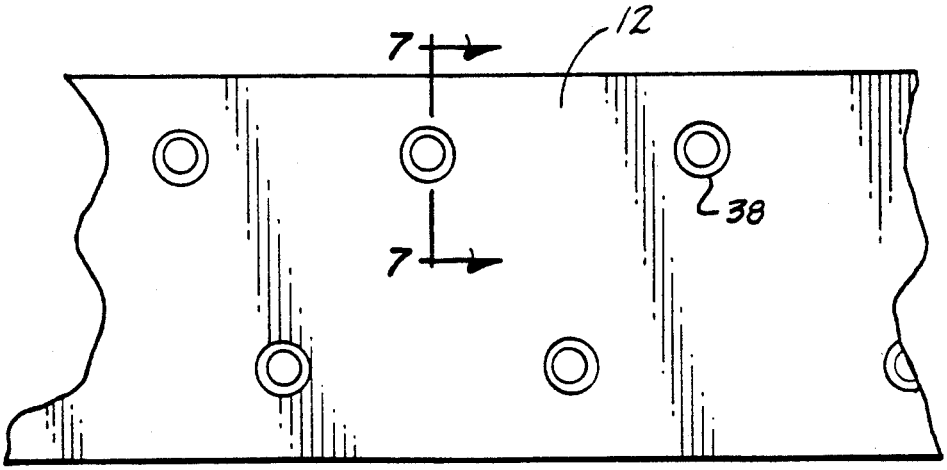
FIG. 6 is an orthographic view, taken along the lines 6—6 of FIG. 3 in the direction indicated by the arrows.
Figure 7:
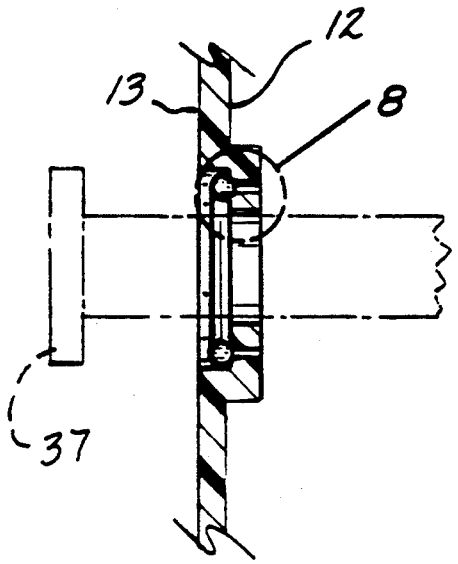
FIG. 7 is an enlarged orthographic cross-sectional illustration, taken along the lines 7—7 of FIG. 6 in the direction indicated by the arrows.
Figure 8:
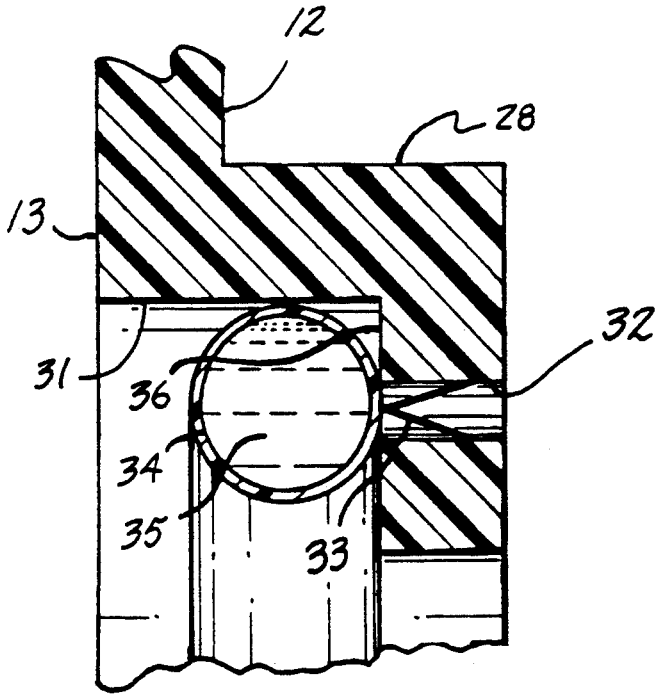
FIG. 8 is an enlarged orthographic view of section 8 as set forth in FIG. 7.

FIG. 6 indicates the use of a plurality of base plate apertures, having base plate apertures first bores 31 (see FIG. 7 and FIG. 8), with the first bores 31 coaxially aligned with second bores 32. The first bores have a first diameter greater than a second diameter of the second bore to provide for an abutment wall 36 intermediate the rear and front walls 12 and 13 extending from each first bore 31 to each respective second bore 32 to receive a fastener 37 into the first and second bores, with the fastener having a fastener head received within the first bore, and the fastener having a fastener shank received through the second bore. An annular piercing blade 33 is mounted within the second bore in contiguous communication into the first bore and in contiguous communication with a torroidal frangible ring 34 mounted onto the abutment wall 36, whereupon projection of the fastener into the first and second bores effects destruction of the torroidal frangible ring 34 releasing a fluid adhesive 35 to insure engagement and bonding of the fastener, as well as the base plate 11 to the associated dwelling in a mounted configuration. The first and second bores, as illustrated, are mounted within a projecting boss 38 that projects rearwardly of the rear wall 12 to space the base plate 11 from the dwelling to minimize accumulation of mold and mildew between the base plate 11 and the associated dwelling and thereby eliminate associated accelerated deterioration of paint and the like positioned between the base plate 11 and the exterior surface of the dwelling.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Christmas light mounting apparatus, comprising, a base plate arranged for securement to a support surface, the base plate having a rear wall and a front wall, with the rear wall coextensive with the front wall in a spaced relationship, and a plurality of spaced bulb sockets mounted to the front wall, with each bulb socket including a bulb member, and the base plate having an uppermost edge and a lowermost edge, with the uppermost edge fixedly mounting a first cover plate extending from the uppermost edge extending over the front wall at a first acute angle, and a second V-shaped cover plate pivotally mounted to the first cover plate about a hinge, with the second V-shaped cover plate including a first web and a second web integrally joined together at an acute second angle, with the first web mounted to the hinge and the second web arranged for selective abutment with the front wall of the base plate adjacent the lowermost edge of the base plate, and the first cover plate has secured thereto a plurality of spaced ferrous metallic first plates, and the first web has secured thereto a plurality of first magnets arranged for selective engagement with the first plates, and the second web includes a second web first end mounted to the first web, and a second web second end having a sealing strip and a second magnet, and the base plate includes a ferrous metallic second plate arranged for engagement with the second magnet to secure the second V-shaped cover plate to the front wall in a first position, with the first plates engaged with the first magnets in a second position when the second V-shaped cover plate is pivoted about the hinge, and the base plate includes a plurality of projecting bosses projecting beyond the base plate and the rear wall, wherein each of the bosses includes a first bore of a first diameter extending from the front wall intermediate the base plate, and each of the projecting bosses includes a second bore having a second diameter less than the first diameter projecting from the first bore through the boss, and the first bore intersecting the second bore at an abutment wall, with the abutment wall having a torroidal frangible ring mounted thereon, and the torroidal frangible ring including a fluid adhesive contained therewithin, wherein a fastener directed through the first bore and the second bore effects rupture of the ring for projection of the fluid adhesive throughout the first bore, the second bore, and the fastener.

2. An apparatus as set forth in claim 1 wherein the abutment wall includes an annular piercing blade positioned in adjacency to the frangible ring to project the frangible ring against the piercing blade to enhance rupture of the ring during projection of the fastener through the first bore and the second bore.

* * * * *